US012281420B2

(12) United States Patent
Papenfuss

(10) Patent No.: US 12,281,420 B2
(45) Date of Patent: Apr. 22, 2025

(54) KNITTING NEEDLE IN PARTICULAR FOR PRODUCING KNITWEAR WITH CABLE PATTERNS, AND METHOD FOR PRODUCING THE KNITTING NEEDLE

(71) Applicant: William Prym GmbH & Co. KG, Stolberg (DE)

(72) Inventor: Andreas Papenfuss, Weimar (DE)

(73) Assignee: William Prym GmbH & Co. KG, Stolberg (DE)

( * ) Notice: Subject to any disclaimer, the term of this patent is extended or adjusted under 35 U.S.C. 154(b) by 469 days.

(21) Appl. No.: 17/249,829

(22) Filed: Mar. 15, 2021

(65) Prior Publication Data

US 2021/0198820 A1 Jul. 1, 2021

Related U.S. Application Data

(63) Continuation of application No. 16/462,930, filed as application No. PCT/EP2017/079895 on Nov. 21, 2017, now abandoned.

(30) Foreign Application Priority Data

Dec. 21, 2016 (DE) ..... 20 2016 007 702.4

(51) Int. Cl.
*D04B 3/02* (2006.01)

(52) U.S. Cl.
CPC ..... *D04B 3/02* (2013.01)

(58) Field of Classification Search
CPC ..... D04B 3/02
See application file for complete search history.

(56) References Cited

U.S. PATENT DOCUMENTS 1,313,461 A * 8/1919 Brown ..... D04B 17/04 66/117
1,966,690 A * 7/1934 Van Bergen ..... D04B 3/00 66/117
2,093,631 A * 9/1937 Burnham ..... D04B 3/02 66/118
2,133,431 A * 10/1938 Craft ..... D04B 17/04 66/117

(Continued)

FOREIGN PATENT DOCUMENTS

CH 186818 A 10/1936
DE 3208379 A1 9/1983

(Continued)

OTHER PUBLICATIONS

International Search Report in International application No. PCT/EP2017/079895, mailed Mar. 20, 2018.

*Primary Examiner* — Megan E Lynch
(74) *Attorney, Agent, or Firm* — Oppedahl Patent Law Firm LLC

(57) ABSTRACT

The invention relates to a knitting needle, in particular for producing knitwear with cable patterns, having at least one rigid needle tip and a shank on which the knitwear can be arranged at least regionally. The invention now proposes that the shank consist at least regionally of a material that is reversibly plastically deformable by bending in very different directions, wherein the transition between the shank and needle tip is flush and smooth. Furthermore, the invention proposes a method for producing such a knitting needle.

10 Claims, 4 Drawing Sheets

(56) References Cited

U.S. PATENT DOCUMENTS

Figure 1:
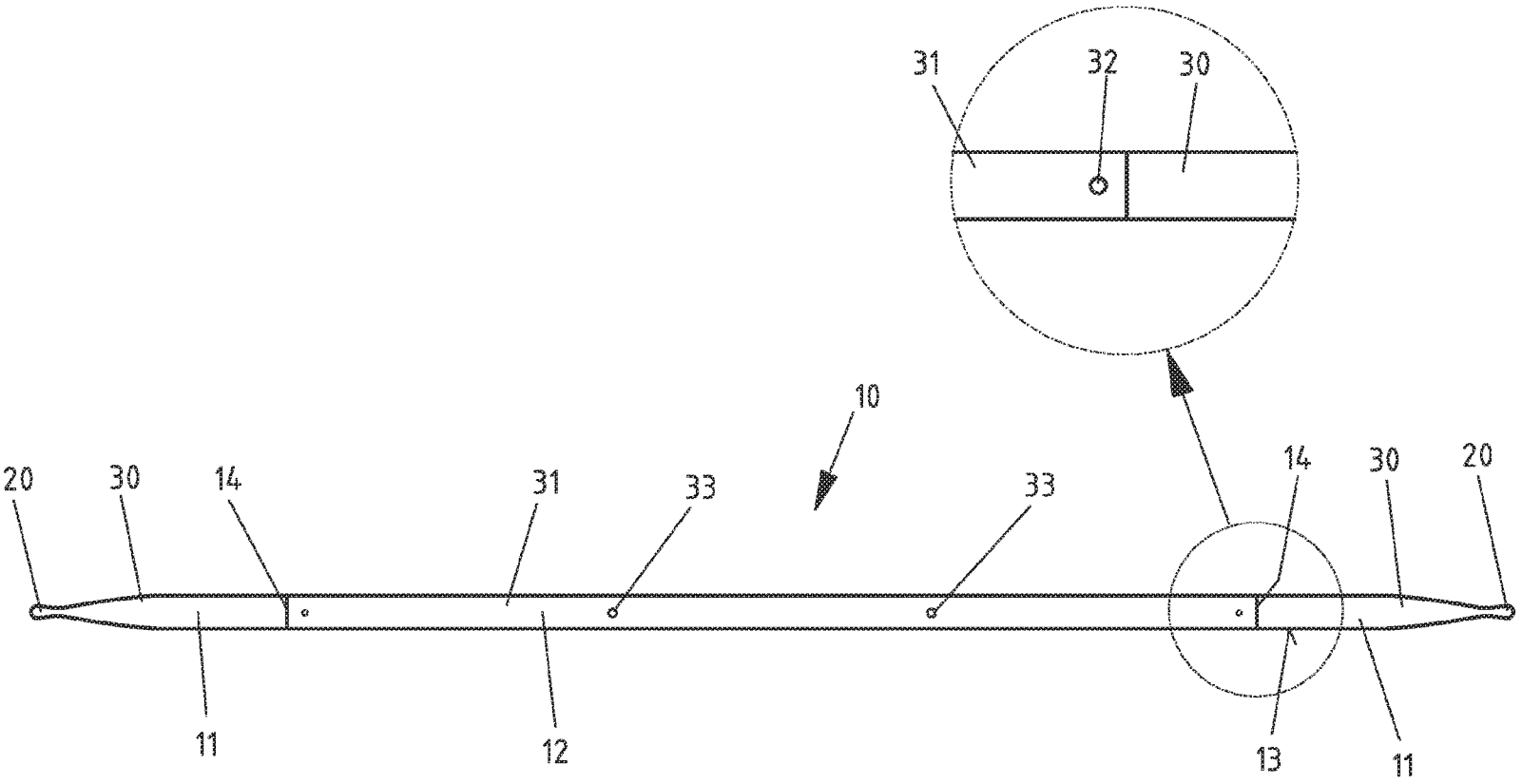

| | | | | | |
|---|---|---|---|---|---|
| 2,695,506 | A * | 11/1954 | Kohlmann | D04B 3/02 | 66/117 |
| 5,720,187 | A * | 2/1998 | Matuo | D04B 3/02 | 66/117 |
| 6,983,627 | B1 * | 1/2006 | Eley-Holden-Sotnik | D04B 3/02 | 66/117 |
| 7,117,693 | B1 * | 10/2006 | Nova | D04B 3/02 | 66/117 |
| 8,210,003 | B2 * | 7/2012 | Zheng | D04B 3/02 | 66/117 |
| 2012/0118021 | A1 * | 5/2012 | Zheng | D04B 3/02 | 66/1 A |
| 2014/0202215 | A1 * | 7/2014 | Zorbach | D04B 3/02 | 66/117 |
| 2015/0240398 | A1 * | 8/2015 | Selter | D04B 3/02 | 66/123 |
| 2016/0265147 | A1 * | 9/2016 | Zorbach | D04B 3/02 | |

FOREIGN PATENT DOCUMENTS

| | | | |
|---|---|---|---|
| DE | 4012563 | A1 * | 1/1992 |
| DE | 19632578 | C2 | 6/2001 |
| DE | 102011119818 | B3 | 10/2012 |
| DE | 202014001683 | U1 | 5/2015 |
| DE | 102015103592 | B3 | 1/2016 |
| KR | 850003106 | Y1 | 12/1985 |

* cited by examiner

KNITTING NEEDLE IN PARTICULAR FOR PRODUCING KNITWEAR WITH CABLE PATTERNS, AND METHOD FOR PRODUCING THE KNITTING NEEDLE

The invention relates to a knitting needle, in particular for producing knitted goods with cable patterns, according to the preamble to claim 1, and also to a method for producing such knitting needles.

Various types of cable patterns in knitted goods are well known. To produce them, a so-called spare needle is usually required, which can consist of an extra knitting needle, a crochet hook, or a double-pointed needle from a set, for example.

It is disadvantageous here that the stitches can unintentionally slip off this needle during knitting.

A knitting needle or crochet hook made of a plastic mass such as, e.g., a plastic material with a metal reinforcement is described by CH 186,818. In order to give the needle the requisite stability and strength to prevent unwanted bending, a rigid metal reinforcement is placed in the interior of the knitting needle. However, no special embodiment of the knitting needle is described here for producing cables and other special applications, and slipping off the stitches is not prevented when it is used as a spare needle.

In DE 10 2015 103,592 B3, a knitting needle is described that can be used in a set of double-pointed needles to produce round knitted goods. The knitting needle in this design has two legs that extend in two different directions at an angle from 37° to 60°. The two legs are connected by a curved, rigid shaft section. It is disadvantageous in this arrangement that the angle between the two legs of the knitting needle is predetermined in a fixed way by the rigid shaft section and cannot be freely chosen at the personal convenience of a user. This knitting needle is rigid and inflexible in its alignment and can also have an interfering effect, depending on the size and scope of the knitted item. Moreover, this shaft section cannot prevent the stitches from slipping off over one of the legs.

DE 10 2011 119,818 B3 describes a knitting needle for producing cable-design knitted goods. The needle in this design includes a shaft section and two leglike sections that are oriented in two different directions of extent and that are rigidly connected to one another. The two directions of extent in this design have an angle between 60° and 120° to one another, while the center of mass is located within this shaft section. This knitting needle, too, is rigid and inflexible in its alignment and can also have an interfering effect, depending on the size and scope of the knitted item. Furthermore, it is also possible here that the stitches it holds can slip off the ends of the leglike sections, depending on how the extra knitting needle is held.

DE 196 32 578 C2 describes a knitting needle with a flexible region and two rigid needle regions for producing tubular knitted goods with a small diameter. The needle regions are angled in one direction with respect to the flexible region. The flexible region in this design has a flattened cross-section and is flexible in one direction. However, the flexible region of this knitting needle attempts to return to the starting position because no plastic deformation of this region takes place. Moreover, the flexible region also cannot be bent in many different directions at the user's convenience, but rather only in one intended direction. The change in cross-section between the needle regions and the flexible region can interfere with knitting activity, since the stitches can get caught on the transition between the flattened cross-section and the round cross-section.

The object of the invention is, therefore, to improve a knitting needle, in particular for producing knitted goods with cable patterns, to the effect that stitches slipping off can be avoided, and the shape of the knitting needle nevertheless does not interfere with or hamper the movement of the stitches. It should also be possible to use the knitting needles with an extremely wide variety of cable patterns and, in doing so, to arrange the central region however the user pleases. An additional object of the invention is to provide a method for producing an improved knitting needle of this nature. The objects are attained by the characterizing features of claims 1 and 10, which have the following particular importance.

The shaft of the knitting needle is composed, at least in sections, of a material that is reversibly plastically deformable by bending, wherein the transition between the shaft and needle tip is flush and smooth. A material that is reversibly plastically deformable by bending is understood for the purposes of the present invention to mean that this region can be bent in virtually any desired way through an application of force, wherein it retains this shape at the end of the application of force until a new force acts on the region. In this case, the material can again take on the same shape as at the start, or else virtually any other desired shape. By this means, the flexible region of the shaft can be bent in many ways by a user, for example, into a U-shape or V-shape or even as an angle or as a loop, which does an especially good job of preventing the knitted material from slipping off the needle. Thus, a user can bend the needle according to the invention into a U-shape or a V-shape, for example, in order to hold stitches, then bend the shaft as a loop to especially effectively prevent the stitches from slipping off, and after that, bend the shaft open again, for example, into an angle shape in order to then knit the stitches. The user can freely select, based on personal preference, the particular shape that is chosen.

One advantage of the knitting needle according to the invention consists in that the cable stitches can be picked up easily with the needle according to the invention, and the needle cannot slip out of the cable stitches as knitting continues. In addition, the needle is not in the way while knitting proceeds with the normal needles, and thus also does not bother the user. The stitches can be moved back and forth easily and at will on the inventive needle itself, and finally can also be taken off again easily.

Preferably, the needle tip itself is strongly rounded in design, and transitions into a teardrop-shaped or pompom-like bulge that is rounded toward the needle tip, a so-called retrieving knob. This retrieving knob in this design has a significantly smaller diameter than the shaft of the needle. It is advantageous here that the risk of injury is minimized because the needle tip is strongly rounded, and a user cannot be pricked or injured by the needle tip. The risk of injury is consequently minimized. The design also keeps the tip from accidentally being stuck through the yarn during knitting, an action that leads to an undesirable knitting result or damages the yarn to be worked.

It is especially beneficial when the knitting needle according to the invention is composed of a wire that is overmolded with one or more plastics. Of course, it is also possible to provide other materials and substances for producing the knitting needle. It is especially simple and preferred, however, to use a flexible wire that is overmolded in the regions of its ends with a first, rigid plastic in order to produce the needle tip or needle tips, and to use a second, pliable and flexible plastic for producing the shaft. As a result, it is especially easy to bring the flexible region of the shaft into a desired shape that said region will also hold. Also, production of the knitting needle according to the invention is easily realized in this way.

In especially preferred fashion, the injection point of the first, rigid plastic in the region of the needle tip simultaneously serves as anchor point for the second, flexible plastic. In this way, a good and secure connection is created between the two plastics, and thus also between the two regions of the knitting needle.

It is advantageous when the needle tip is dimensioned long enough that it can accommodate at least two to three stitches of the knitted good. This produces a good knitting result, and the knitting process can be carried out easily and ergonomically by the user. The stitches can also be moved as desired over the entire region of the knitting needle according to the invention without resistance and with low coefficients of friction, however.

Preferably, the material of the needle tip has a very smooth and slidable surface. This likewise facilitates the knitting process, since only low frictional forces must be overcome while sliding the stitches over the surface of the needle tip. For example, an acrylonitrile butadiene styrene copolymer, also called ABS, can serve as material for the needle tip. This material is sufficiently rigid, can be produced with a very smooth and slidable surface, and is nonhazardous in manufacture and use. The second, flexible plastic can be a thermoplastic elastomer, for example. This is easy to shape in an injection molding process, and has the desired characteristics. In particular, an olefin-based cross-linked thermoplastic elastomer has proven to be advantageous here.

In order to produce a knitting needle according to the invention, first, a wire that is plastically deformable by bending is overmolded at its ends with a rigid plastic to produce the needle tips. After that, the central regions of the wire, which have not as yet been overmolded, are overmolded with a second, flexible plastic, wherein this second, flexible plastic also surrounds sections of the first, rigid plastic, in particular in the region of the injection points of the first, rigid plastic. In this way, the region of the shaft that is plastically deformable by bending is produced and adequately connected to the first, rigid plastic, which forms the needle tips. Advantageously, the wire is positioned centrally in the two plastics during the overmolding therewith, which causes smooth openings to be produced in the second, flexible plastic. The openings here are formed such that they are very fine and smooth, and thus unproblematic for the second, flexible plastic and for knitting.

Figure 2A:
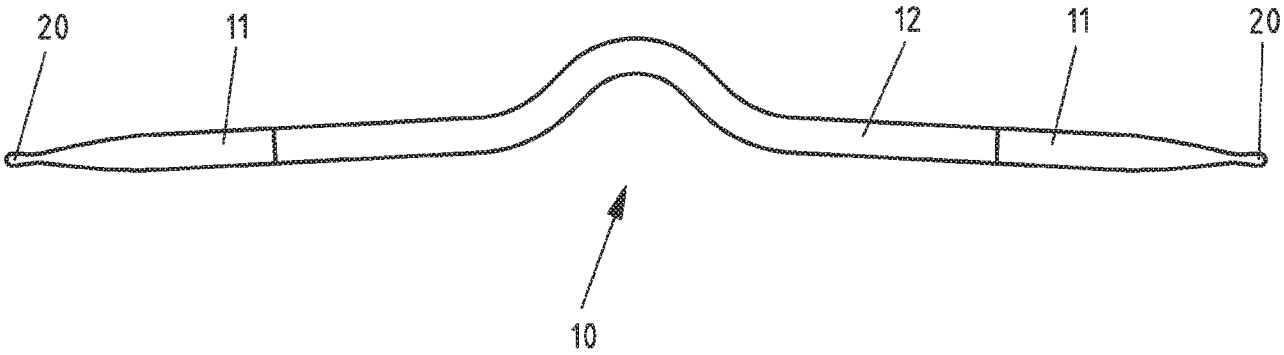
Figure 2B:
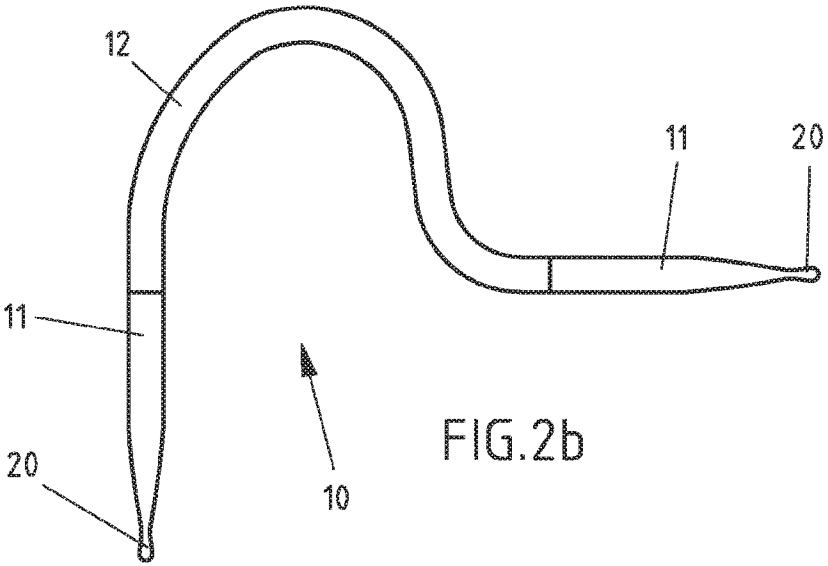
Figure 2C:
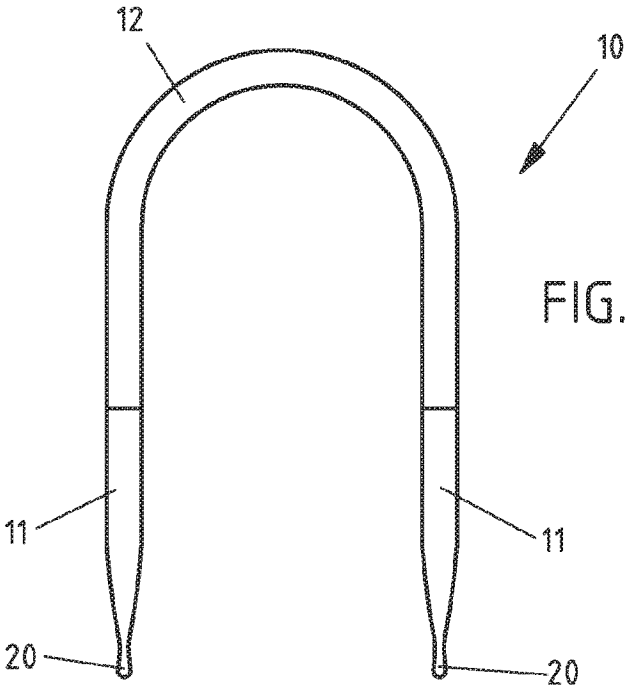
Figure 3:
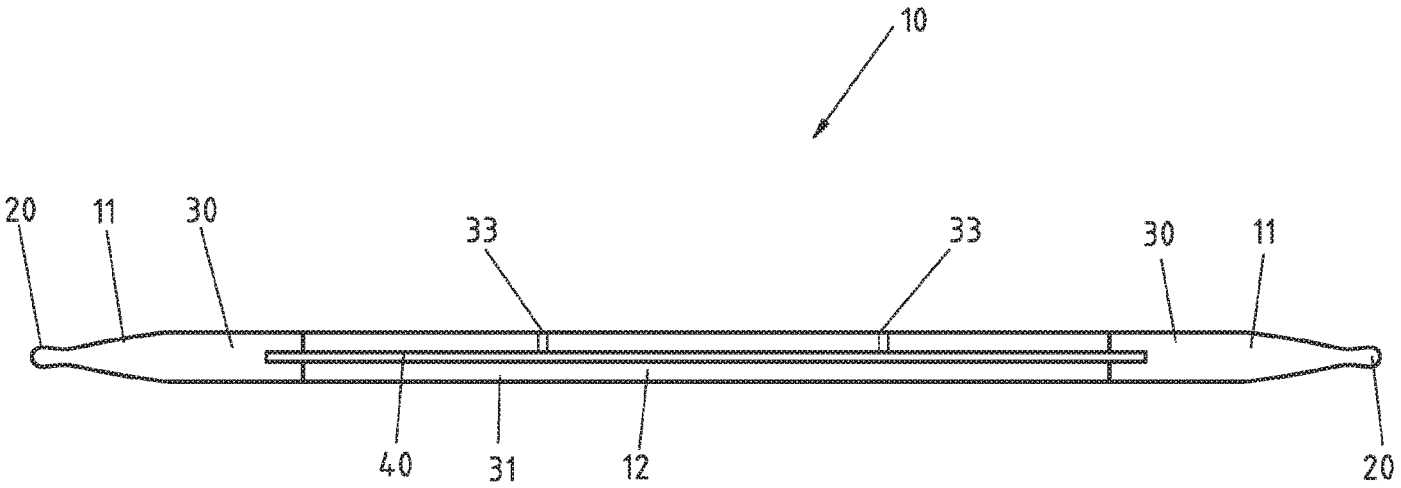
Figures 4A, 4B, 4C:
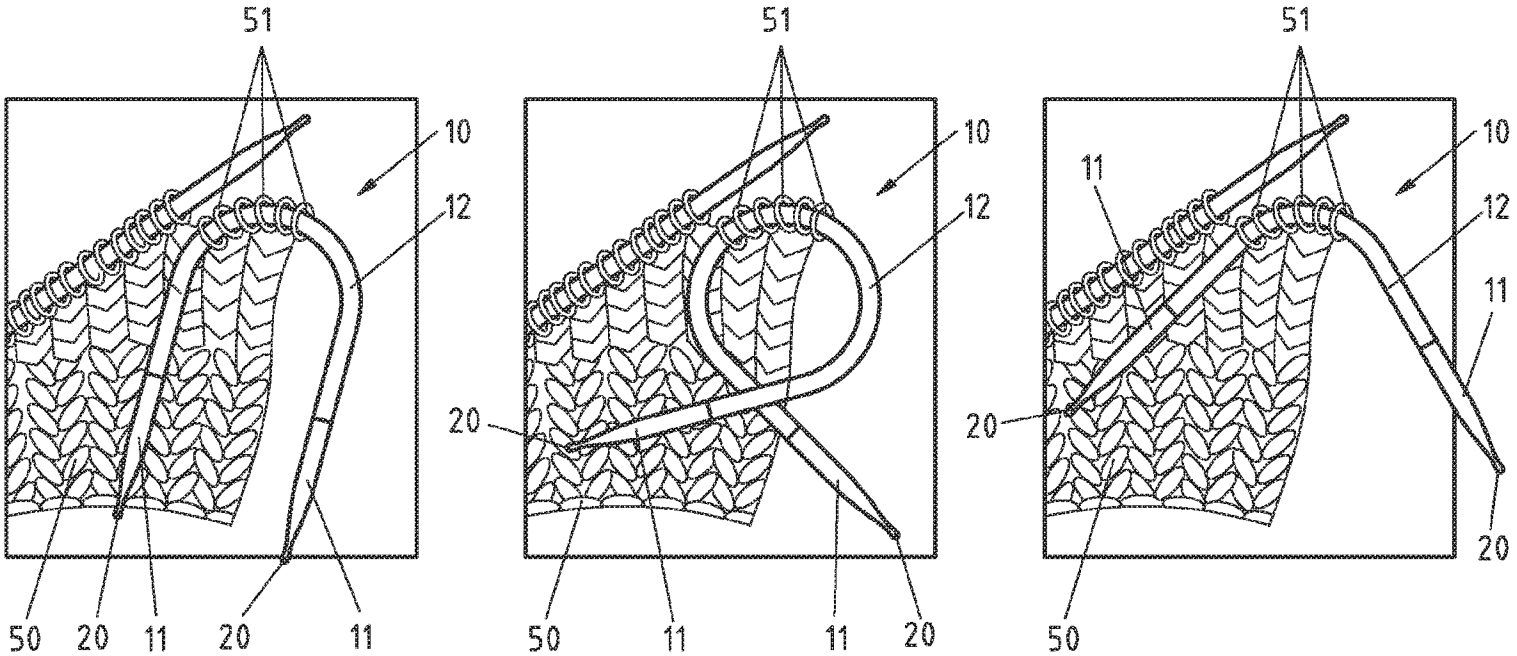

Additional advantages and embodiments are evident from the description below, the dependent claims, and the drawings. In the drawings, the subject matter of the invention is shown in an exemplary embodiment. The figures show:

FIG. 1: a knitting needle according to the invention in a front view,

FIG. 2*a*: a possible first shape into which the kitting needle can be bent, FIG. 2*b*: a possible second shape into which the kitting needle can be bent, FIG. 2*c*: a possible third shape into which the kitting needle can be bent, FIG. 3: the knitting needle according to the invention from FIG. 1 in cross-section, FIG. 4*a*: one possible shape for use of the knitting needle in a U-shape during knitting, FIG. 4*b*: one possible shape for use of the knitting needle in a loop shape during knitting, FIG. 4*c*: one possible shape for use of the knitting needle in a bent shape during knitting.

FIG. 1 shows a knitting needle 10 according to the invention. It has two needle tips 11 that are made of a first, rigid plastic 30. In the region of the shaft 12, a second, flexible plastic 31 has been used. The transition 14 between the shaft 12 and the needle tips 11 is flush and smooth in design here, so that absolutely no projections or the like are produced that would hinder the knitting process.

It is evident in the enlargement shown that the second, flexible plastic 31 surrounds the first, rigid plastic 30 in the region of the injection point 32 as well in order to produce an especially good and inseparable connection between the two plastics 30, 31.

In addition, a rounded bulge, namely the retrieving knob 20, is provided at each of the two needle tips 11. This minimizes the risk of injury so that a user cannot injure himself on a needle tip 11 during the knitting process.

FIGS. 2*a* to 2*c* show the flexibility of the shaft 12. In this regard, a user can bend the knitting needle 10 to shape as desired in order to make pleasant and easy knitting possible for himself. The shapes shown here are merely by way of example in this respect. Every user can put the knitting needle 10 into his own desired shape, and also change this shape at any time.

FIG. 3 shows the internal structure of the knitting needle 10 according to the invention. Visible here is the flexible wire 40, which is overmolded at its ends with a first, rigid plastic 30 in order to form the needle tips 11 and the retrieving knob 20. In the central region, the wire 40 is overmolded by a flexible, elastic plastic 31 in order to form the shaft 12. Furthermore, the openings 33, which were produced by the placement of positioning means, are also visible in the second, flexible plastic 31 of the shaft 12. These positioning means ensure that the wire 40 is located exactly centered in the plastics 30 and 31 during the overmolding of said wire.

FIGS. 4*a* to 4*c* show the use in knitting by way of example. Several shapes of the knitting needle 10 according to the invention can be seen here. These, again, are also shown by way of example. In FIG. 4*a*, the knitting needle 10 is bent into a U-shape in this case. The stitches 51 of the knitted good 50 are arranged in the convex area of the shaft 12 in this example. In order to protect the stitches 51 especially well from slipping off, the knitting needle 10 can also be bent into a loop, as is shown in FIG. 4*b*. In this case, the bent part of the shaft 12 additionally blocks itself so that the stitches 51 cannot slip off. In FIG. 4*c*, the knitting needle 10 is bent at an angle. In this shape, the knitting process can be carried out. Of course, many other shapes are also possible.

In order to produce a knitting needle according to the invention, first, a wire that is plastically deformable by bending is overmolded at its ends with a rigid plastic to produce the needle tips. After that, the central regions of the wire, which have not as yet been overmolded, are overmolded with a second, flexible plastic, wherein this second, flexible plastic also surrounds sections of the first, rigid plastic, in particular in the region of the injection points of the first, rigid plastic. In this way, the region of the shaft that is plastically deformable by bending is produced and adequately connected to the first, rigid plastic, which forms the needle tips.

Advantageously, the wire is positioned centrally in the two plastics during the overmolding therewith, which causes smooth openings to be produced in the second, flexible plastic. The openings here are formed such that they are very fine and smooth, and thus unproblematic for the second, flexible plastic and for knitting.

In conclusion, it should be noted that the embodiments shown here are merely exemplary realizations of the invention. The invention is not limited thereto. Instead, additional modifications and delimitations are possible. In this regard, it is possible, for example, to equip a whole set of knitting needles with the elastic region rather than just one spare knitting needle for producing cable patterns. Also, an entire set of double-ended needles for making socks can be designed in this way. Finally, the regions of the needle tip and shaft can have different proportions to one another. The knitting needle itself can also be produced in different lengths and thicknesses. Moreover, different materials than the ones named can be used for producing the needle.

LIST OF REFERENCE SYMBOLS

10 knitting needle
11 needle tip
12 shaft
13 surface of 11
14 transition between 11 and 12
20 retrieving knob
30 first plastic
31 second plastic
32 injection point of 30
33 opening in 31
40 wire
50 knitted good
51 stitch

The invention claimed is:

1. A knitting needle, for the production of knitted goods with cable patterns, having at least one rigid needle tip and a shaft on which the knitted goods can be arranged at least in sections, characterized in that, the shaft consists, at least in a region, of a material that is reversibly plastically deformable in many different directions by bending in virtually any desired way through an application of force by a user, wherein the shaft retains its shape subsequent to the application of force until a new force acts upon the region, wherein the transition between the shaft and needle tip is flush and smooth, wherein the knitting needle comprises a wire that is overmolded with one or more plastics and wherein the needle tip consists of a first, rigid plastic, and the shaft is composed of a second, pliable, flexible plastic.

2. The knitting needle of claim 1, characterized in that the needle tip is rounded in design, and further characterized in that it transitions into a teardrop-shaped bulge, and has a smaller diameter than the shaft.

3. The knitting needle of claim 1 where in the first hard plastic has an injection point, and wherein the injection point of the first hard plastic simultaneously serves as an anchor point for the second soft plastic.

4. The knitting needle of claim 1, characterized in that the needle tip is so long that it can accommodate two to three stitches.

5. The knitting needle of claim 1, characterized in that the material of the needle tip has a very smooth and slidable surface.

6. The knitting needle of claim 1, characterized in that the first plastic, of which the needle tip consists, is an acrylonitrile-butadiene-styrene copolymer.

7. The knitting needle of claim 1, characterized in that the second plastic, of which the shaft consists, is a crosslinked thermoplastic elastomer.

8. A method for producing a knitting needle according to claim 1, characterized in that the flexible wire in the region of its ends with the first rigid plastic is overmolded to produce the needle tips, and then the non-overmolded areas of the wire are encapsulated with a second pliable flexible plastic, wherein the second pliable flexible plastic also partially surrounds the first rigid plastic, in particular in the region of injection points of first rigid plastic.

9. The method according to claim 8, characterized in that the wire during injection molding with two plastics is positioned centrally in the two plastics.

10. The knitting needle of claim 7 wherein the crosslinked thermoplastic elastomer is an olefin-based crosslinked thermoplastic elastomer.

* * * * *